United States Patent [19]

Brown

[11] Patent Number: 4,872,620

[45] Date of Patent: Oct. 10, 1989

[54] BOBBIN BLOW OUT PLUG

[75] Inventor: Don Brown, St. Pauls, N.C.

[73] Assignee: Burlington Industries, Inc., Greensboro, N.C.

[21] Appl. No.: 145,528

[22] Filed: Jan. 18, 1988

[51] Int. Cl.[4] ..... B65H 75/10; B65H 75/18

[52] U.S. Cl. ..... 242/118.3; 242/18 EW; 242/164

[58] Field of Search ..... 242/118.3, 118.31, 118.32, 242/118.1, 125, 164, 165, 18 EW, 18 R, 35.5 R, 35.6 R, 35.6 E

[56] References Cited

U.S. PATENT DOCUMENTS

| | | | |
|---|---|---|---|
| 465,045 | 12/1891 | Keene | 242/118.1 X |
| 912,564 | 2/1909 | Hastings | 242/118.31 |
| 2,217,459 | 10/1940 | Slaughter | 242/118.1 |
| 2,377,920 | 6/1945 | Atwood | 242/118.31 |
| 2,659,547 | 11/1953 | Broadbent et al. | 242/118.32 |
| 2,688,020 | 2/1954 | Dunlap | 242/118.3 X |
| 3,420,467 | 1/1969 | Bell | 242/118.3 |
| 4,065,073 | 12/1977 | Rohner | 242/131 |
| 4,619,416 | 10/1986 | Matsui et al. | 242/35.5 |
| 4,634,065 | 1/1987 | Kupper et al. | 242/18 |
| 4,681,271 | 7/1987 | Matsui et al. | 242/18 |

*Primary Examiner*—Stanley N. Gilreath
*Attorney, Agent, or Firm*—Rhodes and Coats

[57] ABSTRACT

An improved yarn package holder operable to prevent snagging of yarn on its inner surfaces. The holder includes a tube onto which a length of yarn can be wound which is configured to permit the passage of air through the base of the end plug while simultaneously preventing passage of the yarn end.

10 Claims, 2 Drawing Sheets

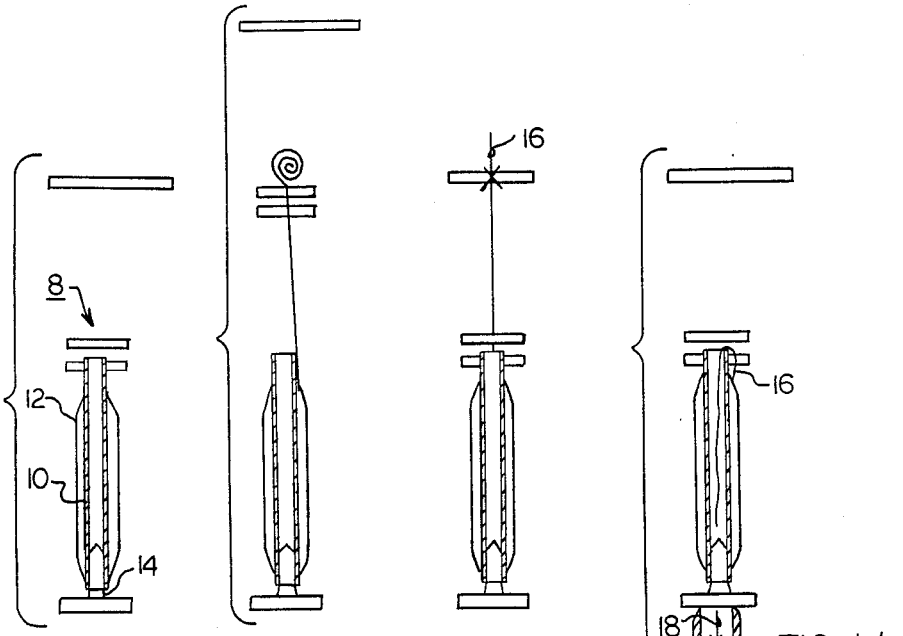
FIG. 1a PRIOR ART
FIG. 1b PRIOR ART
FIG. 1c PRIOR ART
FIG. 1d PRIOR ART
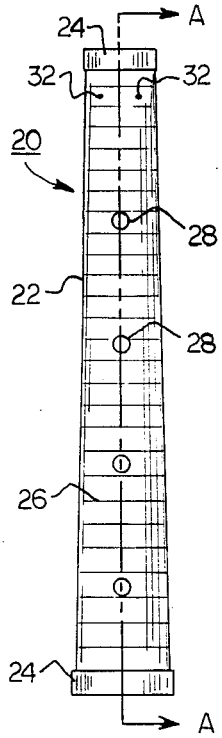
FIG 2 PRIOR ART
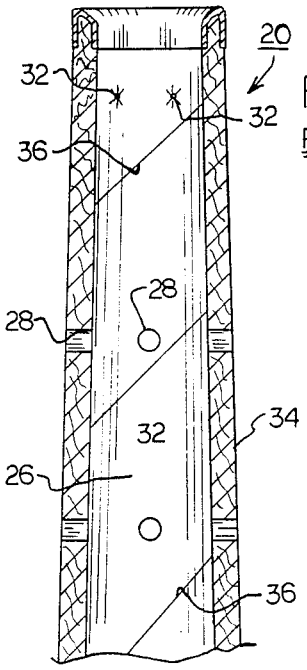
FIG 3 PRIOR ART

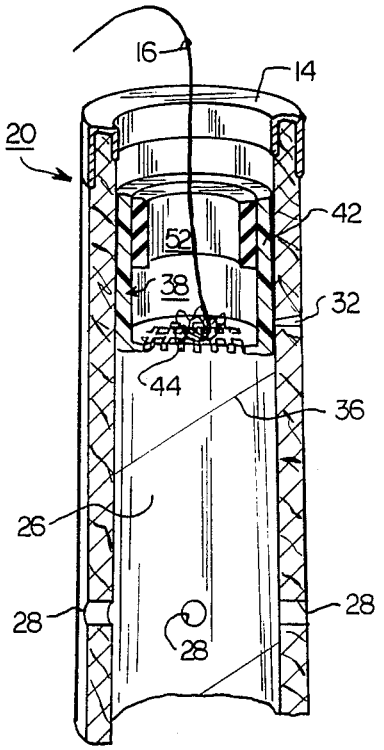
FIG. 4
FIG. 5
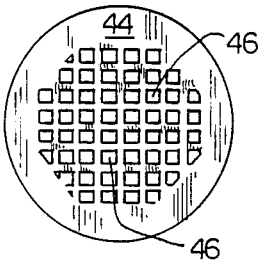
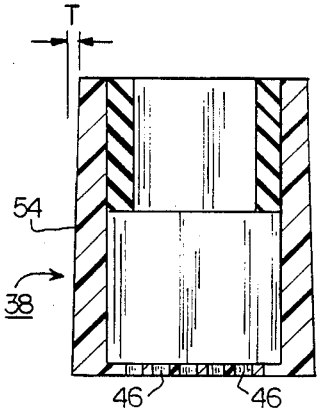
FIG. 6

BOBBIN BLOW OUT PLUG

BACKGROUND OF THE INVENTION (1) Field of the Invention

The present invention relates in general to winding of a yarn supply package and in particular to an improved yarn supply package.

(2) Description of the Prior Art

Normally a bobbin produced on a spinning frame, particularly on a ring spinning frame, has a so-called tail yarn winding in which an end of the yarn is wound several times around a tail or head portion of the spinning bobbin in order to prevent the yarn end from being released from the spinning bobbin or to prevent the yarn end from being entangled with the yarn end of another spinning bobbin while it is transported to the next rewinding step. Further, when a spinning bobbin having such a tail yarn is to be supplied to a rewinding step, that is, to a winding unit of an automatic winder, it can be fed to a yarn end finding device in order that the tail yarn may be released in advance to enable automatic splicing of yarns at the winding unit. Examples of such yarn end finding apparatus devices are shown in U.S. Pat. Nos. 4,619,416 and 4,681,271. The entire disclosures of these patents are hereby incorporated by reference.

However, within such devices lies an inherent problem that has hindered top performance of such machines. Generally the yarn end finding device secures the thread from the spinning package and, through the use of controlled air, "sucks" an end of yarn from the spinning package into the inside cylindrical neck of the yarn package holder. When the yarn package has progressed to the next step of the operation, the yarn end is blown upward from inside the yarn package holder and received by a suction nozzle for splicing or other handling.

Few problems occur with this "blowout" step when the inside surfaces of the yarn package holder are smooth and continuous. However, the rate of "blowout" failure increases to between five and twenty percent when the yarn package holder is either made of paper, as is commonplace in the United States, or has openings along its length, for example, to permit steaming of the yarn package. When the "blowout" operation fails, the yarn package must be recycled, requiring operator attention.

A "blowout" failure can be attributed to a number of causes. For example, the inside walls of a paper yarn package holder are not finished to a smooth surface so the yarn fibers snag, resulting in a failed "blowout." Also, some yarn package holders are made with a positive doff control (PDC) that functions to restrict the yarn package holder from sticking on the spinning spindle. These holders have a perforation that fractures the inside of the wall, thereby causing a rough area very near the top of the yarn package holder on which yarns are likely to snag. Finally, some yarn package holders have a series of small (approximately one-eighth inch diameter) openings through the wall of the yarn package holder to provide for steam penetration during subsequent steaming processes. These are also likely to cause snags.

To date the only choices to correct the "blowout" failure problems have been to either purchase smooth inside wall bobbins, such as plastic bobbins, or to ream the inside surface of existing yarn package holders.

However, purchasing new bobbins requires an extensive capital outlay and the reaming process appears to offer only a short term improvement since the inside surfaces of the yarn package holder soon become roughened.

It has thus become desirable to develop an improved yarn supply package that prevents snagging of the yarn end of the inner surface of the yarn end holder while at the same time eliminates high costs associated in replacing paper packages with the plastic yarn packages and eliminating short term improvement associated with reaming.

SUMMARY OF THE PRESENT INVENTION

The present invention solves the aforementioned problems associated with the prior art by providing an improved yarn package holder which is operable to prevent snagging of the yarn on its inner surface and control insertion of yarn depth into yarn package. The improved yarn package holder includes a tube onto which a length of yarn can be wound and an end plug located within one end of the tube configured to permit the passage of air through the end plug while simultaneously preventing passage of the yarn. This arrangement is operable to prevent snagging of the yarn on the inner surface of the yarn package holder since the yarn never comes in contact with that surface. In a preferred embodiment, an inner elastomeric sleeve is inserted within the end plug to provide enhanced frictional engagement with the yarn end, thereby providing for improved retention of the yarn end during transportation to the next processing step.

Accordingly, one aspect of the present invention is to provide an improved yarn package holder that is operable to prevent snagging of the yarn end on the inner surface of the yarn package holder.

Another aspect of the present invention is to provide an end plug for a tubular yarn package holder which is configured to permit passage of air through the tubular yarn package holder while simultaneously preventing the passage of the yarn end through the opening in the tube.

Still another aspect of the present invention is to provide an improved yarn package holder which is operable to both prevent snagging of the yarn on the inner surface of the yarn package holder and permit passage of air through the yarn package holder, while preventing the passage of the yarn end through the package.

These and other aspects of the present invention will be more clearly understood after a review of the following description of a preferred embodiment of the invention when considered with the drawings.

BRIEF DESCRIPTION OF THE DRAWINGS

FIG. 1 is a schematic view of the operation of a yarn end finding apparatus.

FIG. 2 is a side view of a conventional yarn package holder.

FIG. 3 is a sectional view of one end of the yarn package holder shown in FIG. 2.

FIG. 4 is an enlarged perspective view of the section shown in FIG. 3 illustrating the location of the end plug of the present invention.

FIG. 5 is a bottom view of the end plug of the present invention.

FIG. 6 is a sectional view of the end plug shown in FIG. 4.

DESCRIPTION OF THE PREFERRED EMBODIMENT(S)

FIG. 1 illustrates a conventional yarn end finding apparatus, generally designated 8, is shown schematically. A bobbin 10 having a length of yarn 12 wound on it is mounted on a carrier having an air passage (not shown), whereby it is positioned for finding of yarn end 16 (see FIG. 1*a*). The yarn end is subsequently found and cut to a predetermined length (see FIGS. 1*b*, 1*c*). A flow of air 18 directs the yarn end 16 into bobbin 10 for subsequent processing.

Turning now to FIG. 2, a conventional yarn package holder or bobbin, generally designated 20, is shown. Yarn package holder 20 comprises a tubular, slightly tapered, cylinder 22 having a pair of metal end caps 24 to protect the ends of the cylinder. A series of shallow grooves 26 prevent the yarn from slipping during winding. A plurality of openings 28 extend through the side walls of the cylinder to permit steaming in a separate steaming operation. In addition, positive doff control (PDC) perforations 32 may be used to improve the removal of the yarn supply from the spinning spindle. The "PDC" can be a perforation from the outside wall of the bobbin that fractures the inside of the wall, forming a high potential snag area. The yarn package holder 20 is generally tapered, as shown by taper angle T (FIG. 6), to permit faster yarn removal.

As can be seen in FIG. 3, the PDC perforations may actually fracture inside wall 34 of holder 20. In addition, helical ridges 36 formed along inner wall 34 during the manufacture of holder 20 may cause snagging. Finally, the openings 28 which extend through wall 34 also provide snagging sites.

An enlarged perspective view of a cross-section of a yarn package holder 20 is shown in FIG. 4, illustrating the location of end plug 38 of the present invention. End plug 38 includes a tubular shaped member 42 which is configured to fit within the yarn package holder 20. End plug 38 may be a one-piece insert of molded plastic. The axial dimension of the tubular member 42 is substantially greater than the inside diameter of yarn package holder 20, thereby providing for self-alignment of end plug 38 within holder 20. End plug 38 further includes a base 44 integrally formed on one end. In the preferred embodiment an elastomeric inner sleeve 52 is positioned within end plug 38 to provide an increased frictional coefficient with the yarn and thereby provide better retention of the yarn end during transportation to subsequent processing. In the preferred embodiment, the axial dimension of inner sleeve 52 is no greater than the axial dimension of end plug 38. As is seen in FIG. 4, end plug 38 prevents yarn end 16 from coming in contact with the inner surfaces of yarn package holder 20 which have areas of high snagging potential. Thus, the opportunity for "blowout" failure is eliminated.

FIG. 5 is a bottom view of the end plug 38 of the present invention and shows base 44 having a plurality of openings 46 which are configured to permit the passage of air through the base while simultaneously preventing passage of the yarn end through the opening and into contact with the inner walls of yarn holder 20. This also prevents excessive lengths from entering the holder 20 at all and particularly prevents entry into the suction unit. In the preferred embodiment, the base is in the form of a screen in which there are approximately one hundred openings per square inch and the open area comprises approximately 40% of the inside cross-sectional area of the end plug.

Finally, as best seen in FIG. 6, the outer wall 54 of end plug 38 is gradually tapered inwardly from base 44 to provide a frictional fit within the yarn package holder 20. Other aids to a secure engagement of the plug 38 in holder 20 can also be provided such as external circumferential ribs, adhesive coatings, and the like.

In operation, the end plug 38 (with or without inner sleeve 52) is pressed inside of yarn package 20. It stays there by reason of the interference fit with yarn package holder inner wall 34. In the case where the yarn package holder 20 has a taper along its length to permit faster removal of the yarn, the end plug 38 is inserted into the larger of the two openings of the yarn package 20 and seated in the other end of yarn package holder 20. A tamping rod (not shown) may be used to further tap end plug 38 until the frictional fit with inner wall 34 is sufficient to hold end plug 38 in place during normal use.

End plug 38 prevents yarn end 16 (see FIG. 1*d*) from coming into contact with the inner wall 34 of yarn package holder 20, eliminating the opportunity for snagging of the yarn end with inner wall 34. In the preferred embodiment elastomeric sleeve 52 frictionally engages the yarn end 16, thereby improving retention of yarn end 16 during transportation to subsequent processing.

Various modifications and improvements will occur to those skilled in the art upon the reading of the foregoing description. By way of example, the number and shape and size of the openings 46 in the base 44 of end plug 38 may be varied depending on various factors, including the volume of air required through yarn package holder 20 for purposes of blowout and the denier of yarn end 16. In addition, while end plug 38 is generally cylindrical, other shapes may also be functionally equivalent, such as end plugs having a hexagonal or octagonal cross-sections. It should be understood that all such modifications and improvements are properly within the scope of this invention.

We claim:

1. An improved yarn package holder comprising:

(a) a tube onto which a length of yarn can be wound; and (b) an end plug located within one end of said tube, said end plug including an elongated tubular member configured to fit within the tube and a base integrally formed with one end of said member, said base having perrforations to permit the passage of air through said member, said end plug being operable to prevent snagging of the yarn end on the inner surface of said tubes wherein the axial dimension of said end plug member is greater than the inside diameter of the tube, thereby providing for self-alignment of said end plug within the tube.

2. An improved yarn package holder comprising:

(a) a tube onto which a length of yarn can be wound; and (b) an end plug located within one end of said tube, said end plug including an elongated tubular member configured to fit within the tube and a base integrally formed with one end of said member, said base having perforations to permit the passage of air through said member, said end plug being operable to prevent snagging of the yarn end on the inner surface of said tube, wherein said end plug is generally cylindrical and wherein the axial dimension of said tubular member is greater than the inside diameter of said tube, thereby providing for self-alignment of said end plug within said tube.

3. The apparatus according to claim 1, wherein said perforations in said base are configured to permit the passage of air through said base while simultaneously preventing the passage of the yarn end.

4. The apparatus according to claim 3, wherein the open area of said perforations in said base is greater than 40 percent of the inside cross-sectional area of said tubular-shaped member.

5. The apparatus according to claim 4, wherein said base has at least 100 openings per square inch.

6. An end plug for a tubular yarn package holder onto which a length of yarn can be wound, said end plug being operable to prevent snagging of the yarn on the inner surface of said holder, said end plug comprising:

(a) an elongated tubular member configured to fit within the holder, wherein the axial dimension of said tubular member is greater than the inside diameter of the holder, thereby providing for self-alignment of said tubular member within the holder;

(b) a base integrally formed with one end of said member, said base having perforations to permit the passage of air through said member.

7. The apparatus according to claim 6, wherein said perforations in said base are configured to permit the passage of air through said base while simultaneously preventing the passage of the yarn end.

8. The apparatus according to claim 7, wherein the open area of said perforations in said base are greater than 40 percent of the inside cross-sectional are of said member.

9. The apparatus according to claim 8, wherein said base has at least 100 opening per square inch.

10. The apparatus according to claim 6, wherein said end plug includes a sleeve.

* * * * *